US005733200A

United States Patent [19]

Kim

[11] Patent Number: 5,733,200

[45] Date of Patent: Mar. 31, 1998

[54] AUTOMATED PRACTICE PUTTING GREEN WITH OVERSURFACE BALL RETURN

[75] Inventor: Samuel Kim, Hoffman Estates, Ill.

[73] Assignee: G.L. Technology, Inc., Rolling Meadows, Ill.

[21] Appl. No.: 713,950

[22] Filed: Sep. 13, 1996

[51] Int. Cl.[6] ..... A63B 69/36

[52] U.S. Cl. ..... 473/161; 473/155; 473/153; 473/199

[58] Field of Search ..... 473/160, 161, 473/151, 153, 155, 192, 198, 199

[56] References Cited

U.S. PATENT DOCUMENTS

| | | | |
|---|---|---|---|
| 1,904,034 | 4/1933 | Walstrom | 473/160 |
| 3,011,791 | 12/1961 | Page | 473/161 |
| 3,595,581 | 7/1971 | Anderson | 473/161 |
| 4,247,112 | 1/1981 | Del Raso | 473/161 |
| 5,301,947 | 4/1994 | Kim | 473/161 |
| 5,501,462 | 3/1996 | Shih | 473/161 |

*Primary Examiner*—Mark S. Graham

*Attorney, Agent, or Firm*—Laff, Whitesel, Conte & Saret, Ltd.

[57] ABSTRACT

A practice putting green assembly has a strip of artificial grass supported on an articulated multi-sectional frame. A plurality of motor/lift arm combinations can selectively raise or lower individual hinge points between the frame sections. A programmable circuit such as a microprocessor, is able to store a repertoire of programs of different movements responsive to the individual motor/lift arm combinations. This way, a series of topographies of the artificial grass strip may be selected by a player from a plug-in console connected to the programmable circuit. Putted balls are returned to a player over the grass surface by automatically inclining the target end of the grass strip toward the player, causing a pendulum controlled cup to empty and any balls on the grass surface to roll under gravity back to the player.

3 Claims, 5 Drawing Sheets

AUTOMATED PRACTICE PUTTING GREEN WITH OVERSURFACE BALL RETURN

This invention relates to practice putting greens with an adjustable topography and more particularly to an automated putting green assembly having a topography, programming, and display which may be controlled by a microprocessor.

BACKGROUND OF THE INVENTION

For background information, reference may be made to my earlier U.S. Pat. Nos. 5,087,045; 5,100,145; 5,301,947; and 5,318,303. Each of these patents is for a practice putting green which has a strip of artificial grass or turf to provide a playing surface with a putting tee and a cup or target end. Various arrangements are shown for changing the topography of the artificial grass in order to simulate putting conditions where the surface of the earth may slope in various ways between the ball and the cup. These earlier patents also show various ways of returning the golf balls after they reach the cup or the vicinity thereof.

The various features of these earlier putting greens were manually or automatically controlled to provide the features. For example, the artificial grass may be raised here and lowered there in order to simulate the slope of an actual putting green on a golf course. Some of the ball return apparatus stores golf balls in a magazine which are kicked out one at a time for the player to use. However, the manually controlled structures require the player to invest his time designing the practice green each time that he plays. For example, if he wants to have a certain slope between a ball and a cup, he would have to pull and tie or untie and release one or more ropes. The automatically controlled structures employed vertically moveable actuators at various locations beneath the playing surface to elevate it. These actuators necessitated a sizable surrounding housing for the actuators and playing surface. The putted balls were returned when the actuators elevated the playing surface to cause the balls to roll off into side or rear openings and then into a gutter channel, from which the balls eventually returned to the player.

Accordingly, a desired putting green should be controlled automatically so that, once a repertoire of playing conditions is programmed into a microprocessor, for example, the player may select any of those conditions at the touch of a button. Some of the desired playing conditions would be a full 18-hole repertoire of putting greens, each with a different topography, arranged for four players, some of whom are amateurs and some of whom are professionals. This amounts to playing a total of 72 holes for the four players. A display should be able to identify each of these 72 holes so that the player can know which hole he is then playing. The identification would also likely display a skill level, a cumulative number of strokes, or any other desired information.

It would be most desirable for the putting greens to be compact, easily transportable, and easy to quickly set up or take down, with virtually no assembly required at the time of play. The game may proceed more quickly if the balls return to the putting tee over the surface of the green rather than through the gutter channel, so that the player sees it coming and does not have to wait for a mechanism to kick out the ball.

SUMMARY OF THE INVENTION

In keeping with an aspect of the invention, these and other desirable features are provided by a suitable folding frame supporting a strip of artificial turf. The frame can fold between a compact condition for easy storage or an extended position for enabling a player to practice putting. A plurality of underlaying motors are located at points which can articulate the frame by locally raising or lowering the turf to vary the topography of the playing surface. The individual motors are selectively operated under the preprogrammed control of a microprocessor. Sensors are arranged to detect a passage of the ball rolling over the turf so that the microprocessor always knows where the ball is located. When the ball reaches the cup or the vicinity of the cup, the distant end of the putting green automatically raises to return the ball under gravity over the putting surface.

BRIEF DESCRIPTION OF THE DRAWINGS

A preferred embodiment of the invention is shown in the attached drawings, in which.

DETAILED DESCRIPTION OF THE INVENTION

Figure 1:
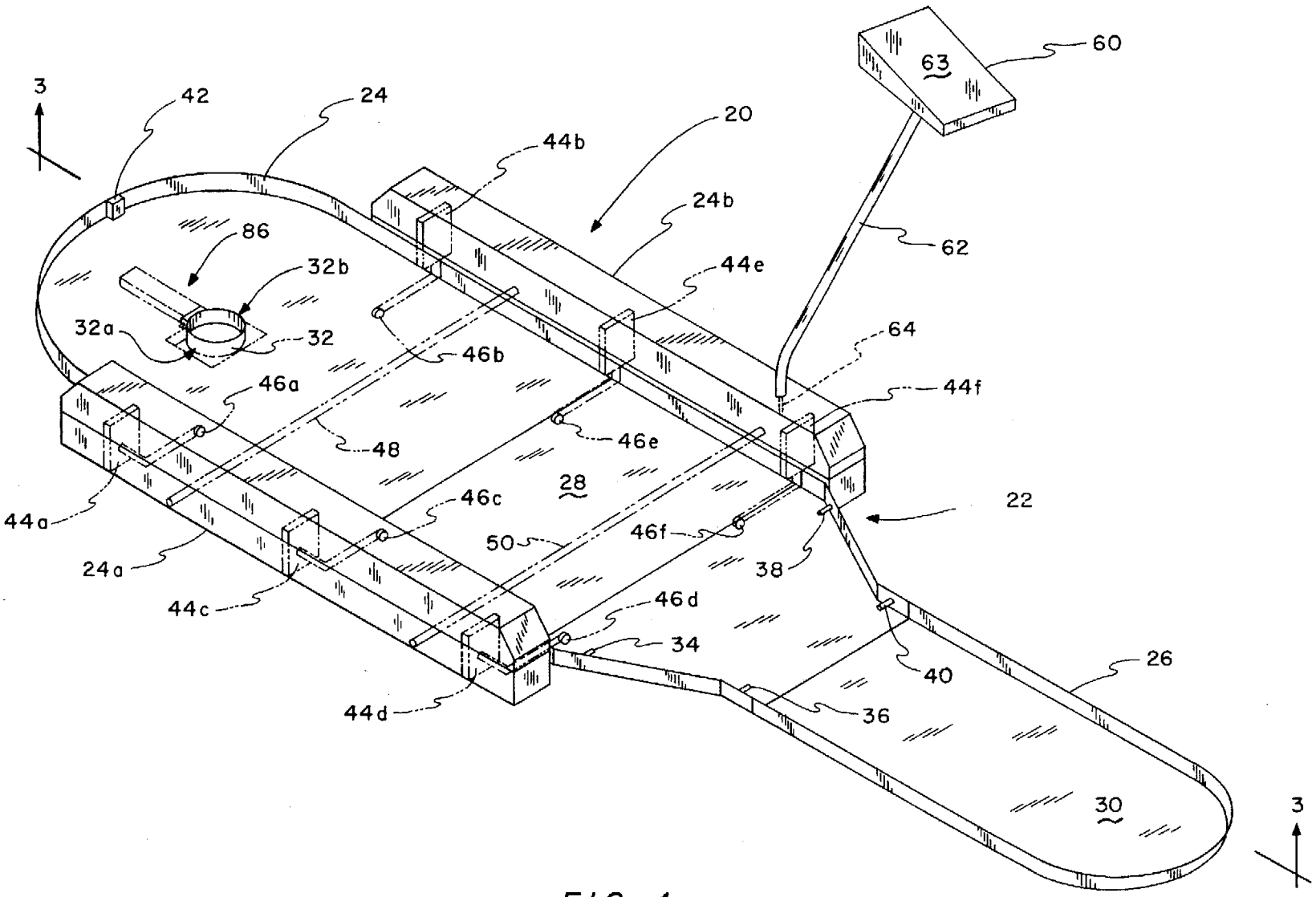
FIG. 1 is a perspective view of the inventive putting greens.

FIG. 1 shows the inventive putting green assembly 20 of artificial turf or grass enclosed within a frame 22 comprising a base 24 and an extension 26 enclosing a tee. A strip 28 of artificial turf or grass extends from tee region 30 to a target or cup 32 and behind the cup. The object of play is to strike a golf ball in the tee region 30 and to drive it into the cup 32.

To continuously monitor and inform a microprocessor of the excursion and position of the golf ball as it rolls over or rests on the green, any suitable number of infrared, vibration, or other suitable proximity sensors may be positioned around the periphery of the putting green and in the cup 32. By way of example, an LED **32*a* is focused on a photocell 32*b* in order to detect when a ball is in cup 32. Two sources of infrared lights 34, 36 are focused on two individually associated, oppositely positioned sensors 38 40. Those infrared sources and sensors are preferably behind a transparent panel that is flush with the wall forming frame 26** so that they will not be struck by or interfere with the travel of the golf ball.

A vibration or sonic sensor 42 may be positioned at the remote end of base 24 from the tee end to track the ball as it approaches the cup. This sensor may be any suitable and well known device.

Figure 2:
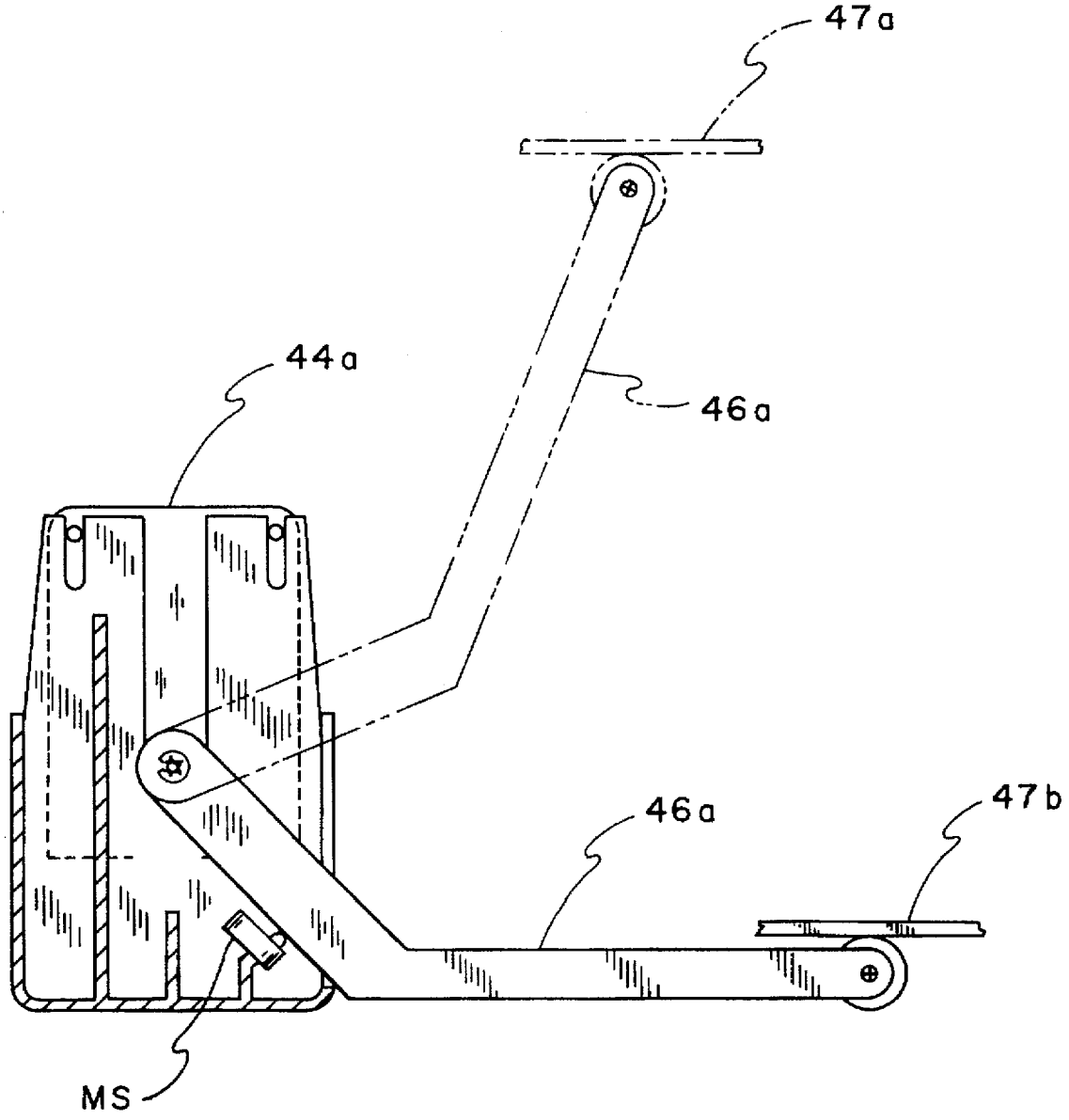
FIG. 2 is a side elevation of a combined motor and topography control lever arm.

The base 24 includes two spaced parallel housings **24*a*, 24*b* which contain any suitable motors, such as 44*a*, 44*b*, 44*c*, 44*d*, 44*e*, and 44*f*, that can control the position of associated topography control lift arms 46*a*, 46*b*, 46*c*, 46*d*, 46*e*, and 46*f* positioned under the artificial grass. Any suitable number, such as two, transverse rods 48, 50, hold the two base housings 24*a*, 24*b* in the spaced parallel relationship. For example, when the motor 44***a* (FIG. 2) is operated one way, the arm 46*a* raises, to give the artificial grass an upwardly sloping contour. When motor 44*a* is operated another way, arm 46*a* lowers to give the artificial grass a downwardly sloping contour. The frame 47*a* for supporting the artificial grass is schematically shown at 47*a* and 47*b*. With six motors and lift arms (FIG. 1), the artificial grass may be raised or lowered in any one of six positions or a combination thereof. A microswitch MS is positioned to detect when arm 46*a* is in its lowermost position in order to disconnect power from the motor. The elevation of the arm is determined by a software timer which permits an infinite variety of heights. Alternatively a selected number of drive pulses could be fed to a stepping motor for raising arm 46*a*.

The motors may take any suitable form depending primarily upon the acceptable cost which can be devoted to them. In the simplest, lowest cost form, they may be solenoids which move the lift arm from a rest position to a raised position. In another form, they may be stepping motors which move the lift arms by a variable amount depending upon the number of stepping drive pulses that are transmitted to them under the control of a microprocessor. A relatively simple multiplex system may enable the microprocessor to send individual motor control signals to individual motors. Hence, the invention lends itself to many different forms from basic to complex, depending upon how much one is willing to spend.

The lift arms may be raised or lowered in any suitable combination. For example, lift arm 46*a* may be raised to about a half raised position while lift arm 46*c* is raised to its highest possible position to give the artificial grass one particular topography. Or, lift arms 46*a*, 46*d* could be raised half way while lift arm 46*c* is raised all the way to give a different topography. There are various possible combinations of positions for the lift arms to create different playing holes.

A microprocessor 60 is mounted at a convenient level on top of a post 62 which may be plugged into or removed from the base 24*b*. The microprocessor has control/display panels 63 at a location convenient for the player. A single, preferably, three conductor plug 64 on the bottom of post 62 plugs into a socket in the base 24. This may be a familiar telephone plug and jack combination having tip, ring, and sleeve contacts. Or, it may be any of the various miniature plugs and jacks, such as a three contact stereo plug and jack. This three contact plug gives eight combinations of binary codes in a manner which is familiar to those skilled in the art. By using any suitable multiplexing technique, such as one type of signals for sensors and another type of signals for motor control, the multiprocessor 60 may be given an even greater flexibility of control with this simple three contact plug. Of course, other well known connectors may also be used to give a greater number of signal combinations.

Thus, a user may program the microprocessor to control the topography of the playing green in any suitable manner. The signals received from the sensors may control a display showing how the ball rolled.

Figure 3:
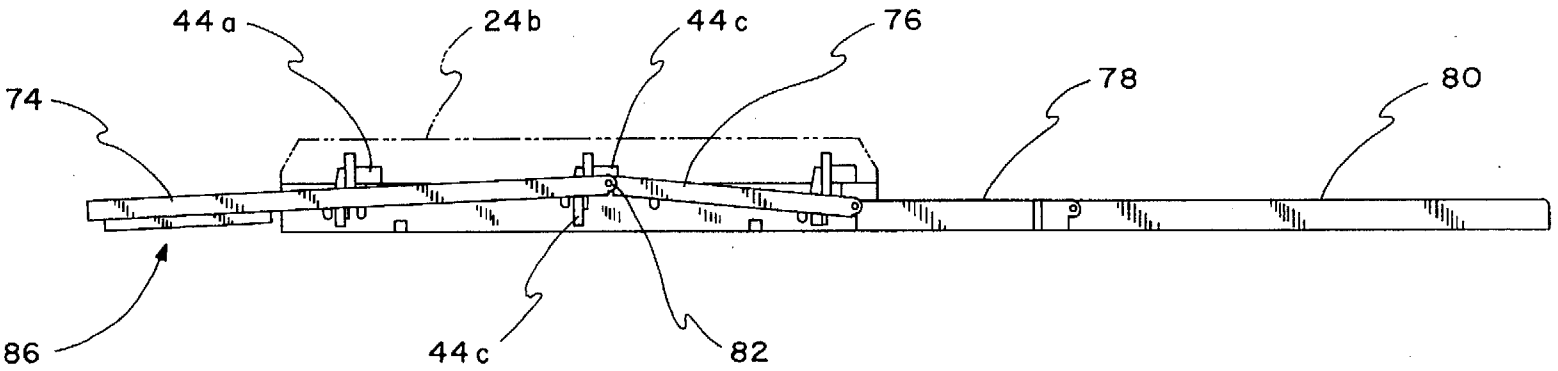
FIG. 3 is a schematic, side elevation taken along line 3—3 of FIG. 1 showing the frame of the inventive putting green while in a playing position.

FIG. 3 shows the folding frame for supporting the artificial turf. A suitable number of frame segments 74–80 are pivotally connected at articulated joints, as at 82, so that they may lay flat on a floor or fold into either a storage or a topographical position. For example, as here shown, the motor 44*c* has operated to raise the hinge 82 so that segments 74, 76 create a "hill" in the artificial grass (not shown in FIG. 3).

Figure 4:
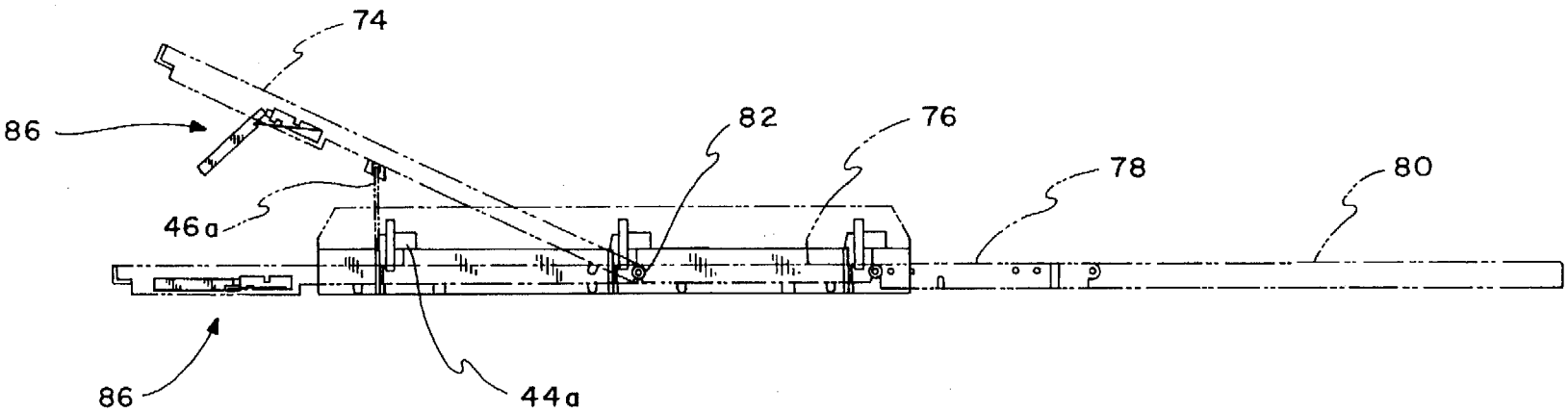
FIG. 4 is a schematic showing similar to that of FIG. 3 with the putting green frame in a ball return position.

FIG. 4 shows how the frame is articulated for ball return. The sensor 42 (FIG. 1) detects the time when the ball stops rolling. Responding thereto, the microprocessor drives motors 44*a*, 44*b* to raise lift arms 46*a*, 46*b* to a maximum position. This in turn raises the frame section 74 to a relatively high position so that any golf balls located there on the artificial grass surface (not shown in FIG. 4) roll under gravity toward the section 80 where the tee is located.

Figure 5:
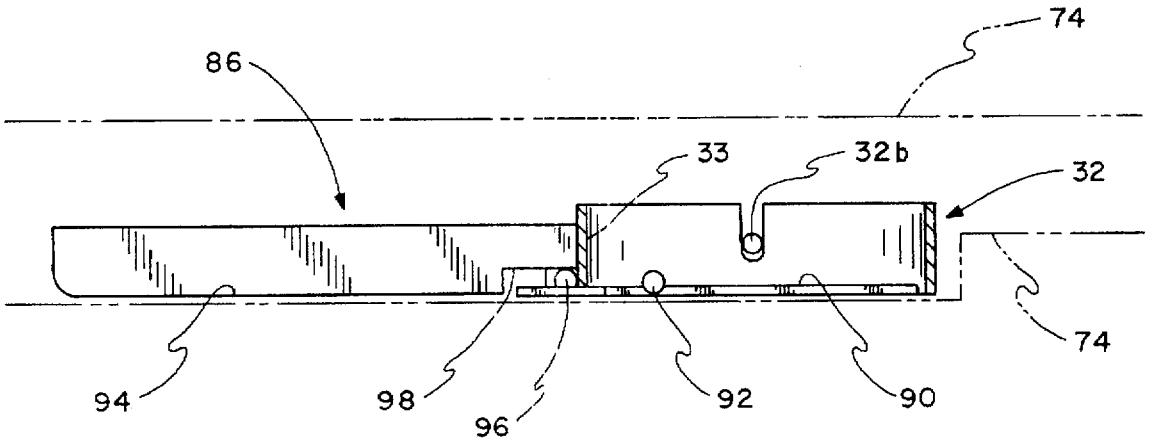
FIG. 5 is a schematic, side elevation showing of the playing position of the cup on the putting green.
Figure 6:
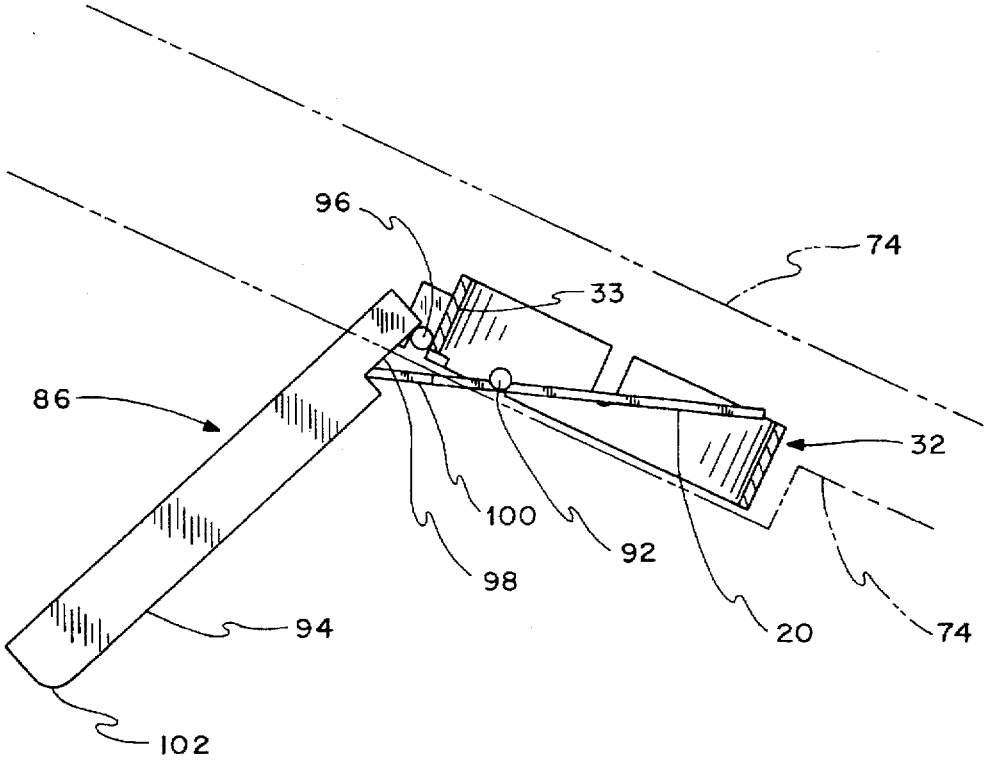
FIG. 6 is a schematic showing similar to that of FIG. 5 with the cup in a ball return position.

The cup mechanism 86 is generally shown in many of the figures and in detail in FIGS. 5 and 6. The mechanism 86 comprises the cup 32 having a cup wall 33 for receiving the golf ball at the end of the putt. The photocell 32*b* is shown in FIG. 5 for detecting a golf ball in the cup 32. Pivoted to the cup at point 92, a kick plate 90 forms the closed bottom of cup 32 while a ball is putted or ready to be putted. A pendulum weight 94, which lays on the floor, has a notch area 98 and is in a position so that it will not engage kick plate 90 while a ball is putted or ready to be putted. The pendulum is hinge-connected to the cup at point 96 in notch area 98.

The dimensions are such that when frame section 74 is laying in a rest position flat on the floor (FIG. 5), the pendulum weight 94 is also laying in a rest position flat on the floor. There is no contact at notch area 98 between the pendulum weight 94 and the kick plate 90. Therefore, the golf ball is free to enter and remain in the cup 32.

When the end frame section 74 raises (FIG. 4) to return the golf ball, the pendulum weight 94 pivots about point 96 and hangs under gravity (FIG. 6). As the end frame section 74 raises, the pendulum 94 moves under gravity from the rest position shown in FIG. 5 to the ball return position shown in FIG. 6. As it so moves, notch area 98 engages an end 100 of the kick plate 20 which extends beyond the circumference at the cup wall 33, causing the kick plate 20 to pivot around point 92. As the kick plate 20 so pivots, it assumes an inclined position which discharges the golf ball from the cup 32.

After the various sensors detect a return of the golf ball, the end frame section 74 returns to the horizontal position shown in FIG. 3. When the lower-most point 102 on the pendulum touches the floor, the pendulum 94 begins to swing, eventually returning to the rest position shown in FIG. 5. The weight of the kick plate 90 is greater on the right (as viewed in FIG. 5) than on the left of pivot point 92. Thus, gravity also causes the kick plate 90 to return to the rest position.

Figure 7:
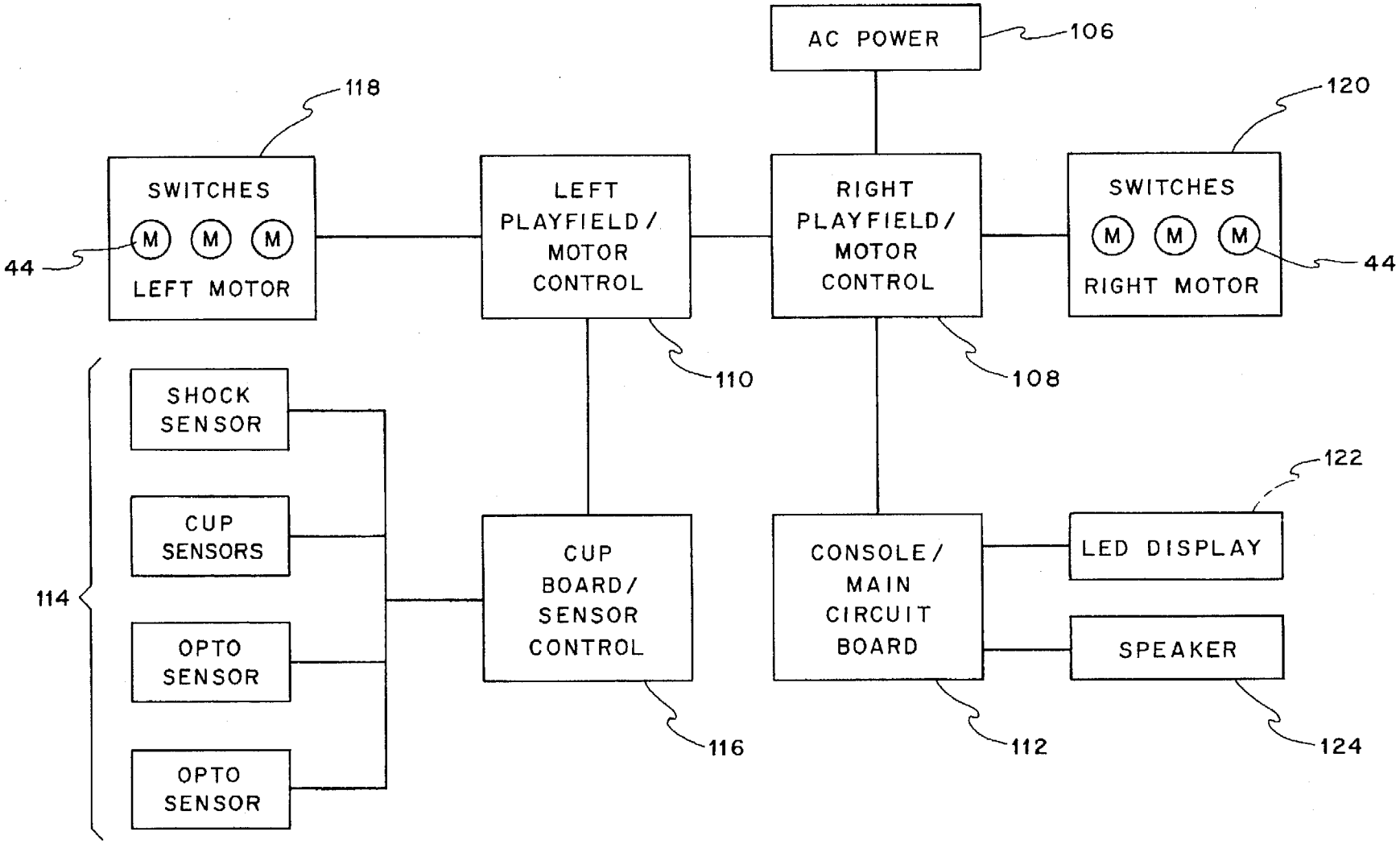
FIG. 7 is a block diagram of the electronic control circuit for the inventive putting green.

The microprocessor is designed and constructed as shown in FIG. 7. The power source 106 is any suitable source which may include a transformer which plugs into a wall socket or the equivalent thereof to produce an appropriate d.c. voltage, for example. In the alternative, a battery may be provided as power source 106. The microprocessor comprises a pair of motor control circuits 108, 110 and a central control or main managing circuit board 112. The sensors 34–40 and 42 (FIG. 1) are shown at 114 as being connected through an interfacing "Cup Board/Sensor Control Circuit" 116 to the motor control circuit 110. The Cup Board/Sensor Control Circuit 116 combination commands the raising of the cup area of the artificial turf or grass (FIG. 5) when the sensors detect the conclusion of a golf ball excursion.

By way of example, the three motors 44 (FIGS. 1, 2) on the left side of frame 22 are controlled from the associate circuits 112, 108, 110, and 118. Hence, all of the motors 44 are individually controlled from the microprocessor.

Before play begins, the player keys data into motor control circuits 110, 108. The data indicates a repertoire of desired topographical contours (e.g. nine holes, eighteen holes), skill levels of the players, and anything else which may be material to practice putting. The left field circuit 110 controls the operation of the left side motors 44, under the jurisdiction of circuit 118. The right field circuit 108 controls the operation of the right side motors 44, under the jurisdiction of circuit 120.

Constantly, the console/main circuit board 112 stores any pertinent data such as the selected contour address numbers the scores the hole currently being played, the skill level, the topography, etc. This data is displayed at 122, preferably by conventional seven segment LED display elements.

A speaker is provided to give any desired sound, which could range from spoken advice on putting techniques, to music, to nature sounds such as one might encounter on a golf course.

In operation, the entire putting green 20 may be folded for storage, as at pivot point 82, for example. There may be wheels (not shown) in the base housings **24*a*, 24*b* in order to facilitate rolling the green 20** away for storage.

To start the play, the user rolls out the putting green 20 and unfolds it to a play position (FIGS. 1, 3). Next, the post 62 is plugged into the base housing **24*b*. A player keys into the display panel 63 the data requested by the programmed microprocessor. The microprocessor then automatically drives motors 44** to create the topographies for each hole from the selected programmed data.

Thereafter, the sensors 34–42 keep track of the golf ball after each putt, relaying the resulting data to the cup board/sensor control circuit 116. The relayed data preferably causes an LED display at 122.

After the person finishes his putting practiced he pulls post 62 out of the socket in base housing unit **24*b*, folds the frame sections 74–80** and moves the entire unit to a storage area.

Those who are skilled in the art will readily perceive how to modify the invention. Therefore, the appended claims are to be construed to cover all equivalent structures which fall within the true scope and spirit of the invention.

The claimed invention is:

1. An automated practice putting green assembly for use on a floor comprising:

a playing surface having a tee region and a remote target region including a ball cup;

an articulated multi-segmented folding frame for supporting said playing surface;

motor-driven means individually associated with said segments of said frame for selectively articulating individually associated ones of said segments in order to vary the topography of said playing surface, said motor driven means comprising a plurality of motors housed adjacent to said frame in combination with lift arms extending from said motor to beneath said playing surface, said lift arms being driven by individually associated ones of said motors, there being a motor/lift arm combination at each location on said frame where said articulation can occur;

programmable electronic control means for operating said motor driven means to selectively position said segments of said frame;

sensor means for monitoring an excursion and position of a golf ball as it moves from said tee region to said target region, said sensor means including a sensor in said ball cup, said sensor means coupled to said programmable electronic control means to continuously inform said programmable electronic control means of said excursion and position of said golf ball;

wherein said motor-driven means are jointly responsive to said sensor means and said programmable electronic control means for automatically raising said target region sufficiently to cause a putted golf ball thereon to return to said tee area over said playing surface;

wherein said ball cup has a movable bottom plate and a gravity activated pendulum controlling movement of said bottom plate, said pendulum causing said bottom plate to expel a golf ball in said cup responsive to said raising of said target region; and wherein said pendulum includes first and second pendulum ends, said first end having a notch area, said movable bottom plate of said ball cup having first and second plate ends, said movable bottom plate being secured to said ball cup at a plate connection point nearer to said first plate end than said second plate end such that said movable bottom plate is rotatable around said plate connection point, said first pendulum end being secured to said ball cup at a pendulum connection point such that said pendulum is rotatable around said pendulum connection point, said second pendulum end being weighted and lying on the floor and said first plate end occupies said notch area without engaging said first pendulum end when said target region is in an unraised position, said second pendulum end hanging under gravity above the floor and rotating said pendulum about said pendulum connection point so that said notch area engages said first plate end and rotates said movable bottom plate about said plate connection point so as to raise said second plate end and expel a golf ball in said ball cup when said target region is in a raised position.

2. An automated practice putting green assembly comprising:

an elongated strip of artificial turf having two side edges and extending from a tee area to a cup area;

means for sensing both a complete excursion and instantaneous locations of a golf ball as it moves from said tee area to said cup area;

programmable control means for storing a repertoire of topography programs for said strip of artificial turf;

means for selecting any one of said plurality of topography programs for said artificial turf;

means for creating the selected topographies of said artificial turf and for automatically raising said cup area of said artificial turf sufficiently for returning said golf ball under gravity to said tee area over said turf, including a plurality of combined motor/lift arm means distributed along each of said two side edges of said artificial turf, said programmable control means individually controlling said motor/lift arm means in order to change said topography of said artificial turf according to the selected topography program;

said programmable control means comprising first and second motor control circuits individually associated with said motor/lift arm means and a main managing circuit board for controlling a display and for operating said first and second motor control circuits;

a cup board/sensor control means coupled to at least one of said motor control circuits for causing said motor/lift arm means to raise said cup area of said artificial turf;

a frame for supporting said artificial turf, said frame having a plurality of sections hinged to each other so that individual frame sections can pivot relative to each other for raising and lowering individual selected ones of said sections relative to other of said sections, said motor/lift arm means being individually associated with said frame sections so that said lift arm part of said motor/lift arm means can cause a selected hinge section to pivot, thereby altering the topography of said artificial turf; and a pendulum controlled cup accessible from said artificial turf and responsive to said raising of said cup area of said artificial turf, for expelling a golf ball contained in said cup, said pendulum controlled cup comprising a pendulum including first and second pendulum ends, said first end having a notch area, a ball cup including a movable bottom plate having first and second plate ends, said movable bottom plate being secured to said ball cup at a plate connection point nearer to said first plate end than said second plate end such that said movable bottom plate is rotatable around said plate connection point, said first pendulum end being secured to said ball cup at a pendulum connection point such that said pendulum is rotatable around said pendulum connection point, said second pendulum end being weighted and lying on the floor and said first plate end occupies said notch area without engaging said first pendulum end when said cup area is not raised, said second pendulum end hanging above the floor under gravity and rotating said pendulum about said pendulum connection point so that said notch area engages said first plate end and rotates said movable bottom plate about said plate connection point so as to raise said second plate end and expel a golf ball in said ball cup when said cup is raised.

3. An automated practice putting green assembly comprising:

a playing surface having a tee region and a remote target region;

an articulated multi-segmented folding frame for supporting said playing surface;

motor-driven means individually associated with said segments of said frame for selectively articulating individually associated ones of said segments in order to vary the topography of said playing surface, said motor driven means comprising a plurality of motors housed adjacent to said frame in combination with lift arms extending from said motor to beneath said playing surface, said lift arms being driven by individually associated ones of said motors, there being a motor/lift arm combination at each location on said frame where said articulation can occur;

programmable electronic control means for operating said motor driven means to selectively position said segments of said frame;

a ball cup having a movable bottom plate and a gravity activated pendulum controlling movement of said bottom plate, said pendulum causing said bottom plate to expel a golf ball in said cup responsive to said raising of said target region, and wherein said pendulum includes first and second pendulum ends, said first end having a notch area, said movable bottom plate of said ball cup having first and second plate ends, said movable bottom plate being secured to said ball cup at a plate connection point nearer to said first plate end than said second plate end such that said movable bottom plate is rotatable around said plate connection point, said first pendulum end being secured to said ball cup at a pendulum connection point such that said pendulum is rotatable around said pendulum connection point, said second pendulum end being weighted and lying on the floor and said first plate end occupies said notch area without engaging said first pendulum end when said target region is in an unraised position, said second pendulum end hanging under gravity above the floor and rotating said pendulum about said pendulum connection point so that said notch area engages said first plate end and rotates said movable bottom plate about said plate connection point so as to raise said second plate end and expel a golf ball in said ball cup when said target region is in a raised position.

* * * * *